US007093400B1

(12) United States Patent
Thompson et al.

(10) Patent No.: US 7,093,400 B1
(45) Date of Patent: Aug. 22, 2006

(54) CONCRETE INSERT FOR POURED CONCRETE FLOORS

(76) Inventors: William J. Thompson, 11 Hillsborough, Newport Beach, CA (US) 92660; Keith L. Watkins, 4240 Cedar Creek, Yorba Linda, CA (US) 92886

( * ) Notice: Subject to any disclaimer, the term of this patent is extended or adjusted under 35 U.S.C. 154(b) by 0 days.

(21) Appl. No.: 11/290,994

(22) Filed: Nov. 29, 2005

Related U.S. Application Data

(60) Provisional application No. 60/663,624, filed on Mar. 21, 2005.

(51) Int. Cl.
*E04B 1/38* (2006.01)

(52) U.S. Cl. ..... 52/698; 52/704

(58) Field of Classification Search ..... 52/698, 52/699, 700, 704, 707; 411/82, 352, 353, 411/930

See application file for complete search history.

(56) References Cited

U.S. PATENT DOCUMENTS 3,042,161 A * 7/1962 Meyer, Jr. ..... 52/166
3,769,774 A * 11/1973 Barnes ..... 52/698
3,843,080 A * 10/1974 Imai et al. ..... 248/58
4,911,726 A * 3/1990 Warkentin ..... 81/124.2
5,568,711 A * 10/1996 Popp et al. ..... 52/704
6,240,697 B1 6/2001 Thompson
6,309,158 B1 * 10/2001 Bellinghausen et al. .... 411/353
2004/0096292 A1 * 5/2004 Duran et al. ..... 411/352

* cited by examiner

*Primary Examiner*—Naoko Slack
*Assistant Examiner*—Jessica Laux
(74) *Attorney, Agent, or Firm*—Dennis W. Beech

(57) ABSTRACT

The concrete insert may be positioned in concrete structures for attachment rods or other structural fasteners. A shaft may have a head to form a projecting edge at a first end and a hole at a second end. There may be slots formed in an external surface of the shaft oriented parallel to the shaft longitudinal axis. The external surface may have multiple retaining flats positioned intermediate the slots and approximately parallel to the slots. The retaining flats may not extend to the second end. A plate groove may be circumferentially formed in the external surface intermediate the first end and the second end. A plate may have an aperture that may be the form of a lateral cross section of the shaft, and may have projections to engage the slots or the flats. A spring may be placed on the shaft between the head and the plate.

11 Claims, 3 Drawing Sheets

CONCRETE INSERT FOR POURED CONCRETE FLOORS

This application claims the benefit of U.S. Provisional Application 60/663,624, filed on Mar. 21, 2005

BACKGROUND OF THE INVENTION

This invention relates to devices for receiving threaded rods for attachment to overhead concrete structures, such as, ceilings, beams, bridge bottom surfaces or other overhead forms. The new threaded insert may be positioned in a metal deck or form prior to the pouring of concrete. The metal insert anchored in the cement may then have a threaded rod threadably attached at one end and the threaded rod at a free end may be used to support decorative ceilings, utility structures, ducts, conduit, air conditioners and other overhead elements.

Various concrete inserts or anchors may have been used to retain support rods in ceilings that are the poured concrete floor above, or in other overhead structures. These devices are described in U.S. Pat. No. 6,240,697, issued Jun. 5, 2001, and this patent is hereby incorporated by reference. The threaded anchor disclosed in the referenced patent may have had marginal structural characteristics to withstand impact or horizontal forces that may have been imparted to the device at structural building sites. Construction personal and work operations may skew or cause misalignment of the anchor device prior to the pouring of concrete. The plastic sleeve and retaining fingers may become damaged such that the spring may force the shaft out of the plate to make the anchor useless.

SUMMARY OF THE INVENTION

The present invention is directed to devices for positioning in concrete structures for attachment of support rods or other structural fasteners. A shaft may have a head to form a projecting edge at a first end and a hole at a second end. There may be slots formed in an external surface of the shaft oriented parallel to the shaft longitudinal axis and extending to the second end. The external surface may have multiple retaining flats positioned intermediate the slots and approximately parallel to the slots. The retaining flats may not extend to the second end.

A plate groove may be circumferentially formed in the external surface intermediate the first end and the second end. The plate groove may intersect the slots and the retaining flats. A plate may have an aperture that may be the approximate form of a lateral cross section of the shaft. The aperture may have projections at an edge that may extend radially inward to engage the slots when the shaft may be slidably inserted in the aperture.

A spring may be placed on the shaft and retained between the head and the plate slidably placed on the shaft. The plate may be retained on the shaft against the spring's force by rotating the plate in the plate groove to move the projections from the slots to the retaining flats.

These and other features, aspects and advantages of the present invention will become better understood with reference to the following drawings, description and claims.

DETAILED DESCRIPTION

The following detailed description represents the best currently contemplated modes for carrying out the invention. The description is not to be taken in a limiting sense, but is made merely for the purpose of illustrating the general principles of the invention.

Figure 1:
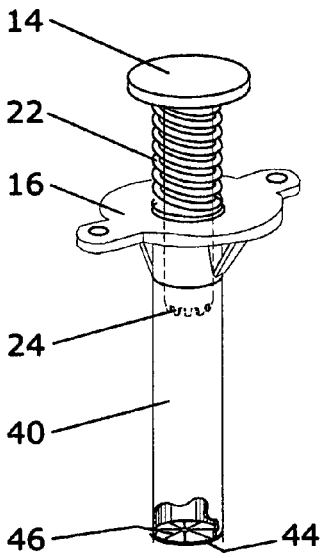
FIG. 1 PRIOR ART
FIG. 1 illustrates a perspective view of a prior art device.
Figure 2:
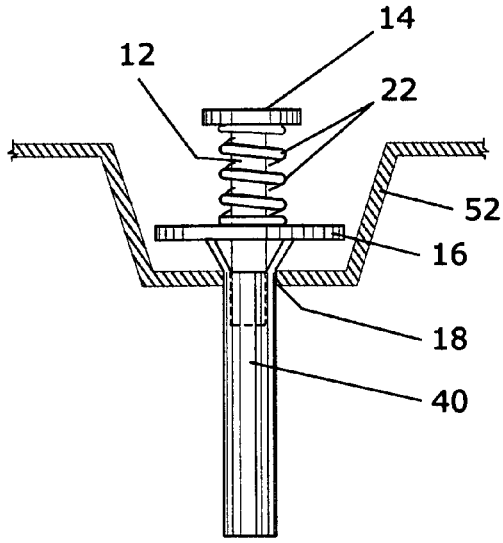
FIG.2 PRIOR ART
FIG. 2 illustrates a side elevation view of a prior art device positioned for insertion in a metal deck.
Figure 3:
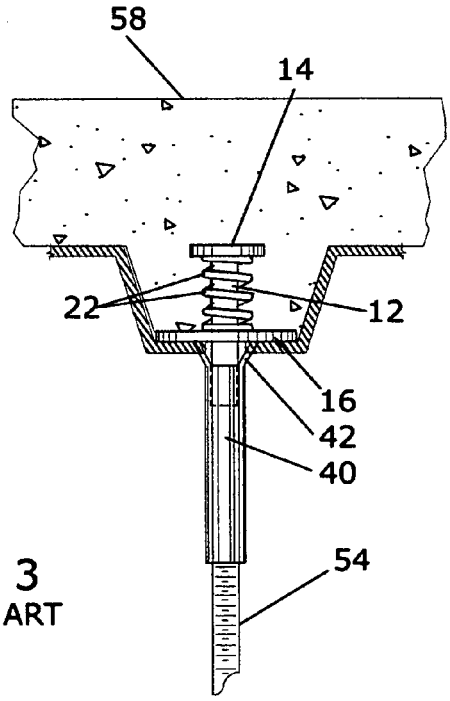
FIG. 3 PRIOR ART
FIG. 3 illustrates a side elevation view of a prior art device positioned in a metal deck after a concrete pour.
Figure 4:
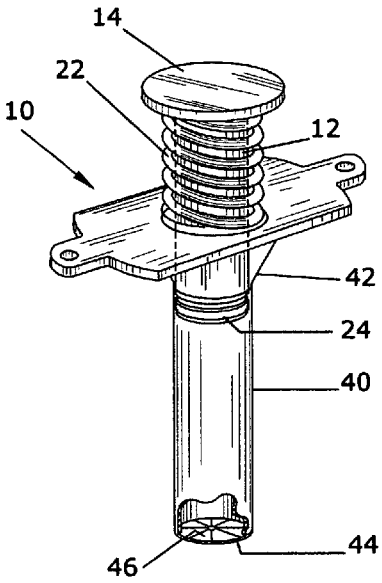
FIG. 4 illustrates a perspective elevation view of the concrete insert according to an embodiment of the invention.
Figure 5:
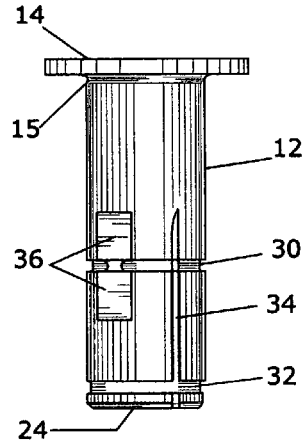
FIG. 5 illustrates a side elevation view of the shaft with head according to an embodiment of the invention.
Figure 6:
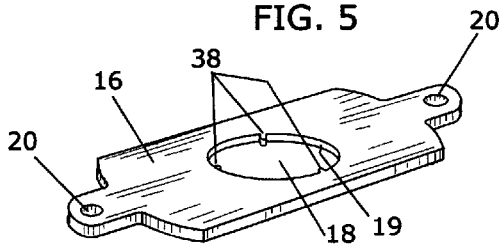
FIG. 6 illustrates a perspective view of a plate according to an embodiment of the invention.

Referring to FIGS. 1 through 3, a concrete anchor or insert 10 may have a cylindrical shaft 12 with a head 14 at a first end 15. The shaft 12 may be slidably inserted in an aperture 18 of a plate 16. A coil spring 22 may be disposed on the shaft 12 and retained between the head 14 and plate 16. A sleeve 40 may be press fitted on the body of the shaft 12 at a second end 24.

The sleeve 40 may be formed of plastic, composite material or the like and may have fingers 42 at a first end and an opening 44 with a cover 46 at a second end. The cover 46 may be serrated to allow ease of insertion of a support rod 54 therein to be threadably attached to the concrete insert 10. The concrete insert 10 may have a hole 26 at the shaft 12 second end 24 that may have multiple diameter threaded portions to accommodate different diameter support rods 54 or other structural fasteners for supporting objects relative to concrete.

Referring to FIGS. 4 through 8, one or more slots 34 may be formed in the surface of the shaft 12 oriented parallel to the shaft longitudinal axis. Projections 38 may be formed on the edge 19 of the aperture 18 in position to slide in slots 34 when the shaft 12 is slidably inserted in the aperture 18. This may inhibit rotation of the shaft 12 in the plate 16 to reduce potential damage to the concrete insert 10 prior to a concrete pour that secures the concrete insert 10.

There may be an annular plate groove 30 circumferentially formed in the surface of the shaft 12 intermediate the first end 15 and the second end 24. The plate groove 30 may intersect the slots 34. The plate groove 30 may allow the projections to rotate in the plate groove 30 to allow the plate 16 to be rotated about the shaft 12.

There may be retaining recesses 36 that may be slots or flats formed in the surface of the shaft 12 intermediate and approximately parallel to the slots 34. The retaining flats 36 may not extend to the second end 24. While a cylindrical shaft 12 has been illustrated, other shaft 12 structures may be used, for example, square, hexagonal and the like cross sectional shaft 12 may be used. Also, flats 36 have been described to retain the plate 16 on the shaft 12; however, variations such as slots may be used that prevent the plate 16 from being forced off the shaft 12 by the spring 22 or other force.

For assembly, the spring 22 may be placed on the shaft 12 abutting at one end against the head 14. The shaft 12 may be slidably inserted in aperture 18 with projections 38 positioned in slots 34. The plate 16 may be forced against the spring 22 to compress the spring 22 sufficiently to bring the projections in alignment with the plate groove 30. The plate 16 may then be rotated about the shaft 12 to position the projections 38 in the retaining flats 36. The plate 16 may than be released for the projections 38 to be stopped at the ends of the flats 36. This should inhibit unwanted separation of the parts of the concrete insert 10 that may be caused by damage that may release the spring 22 to cause separation of the parts.

A sleeve 40 formed of plastic, composite material or the like may be press fitted on the shaft 12 at the second end 24 wherein the sleeve groove 32 may receive an interior protrusion formed in the sleeve 40.

Figure 8:
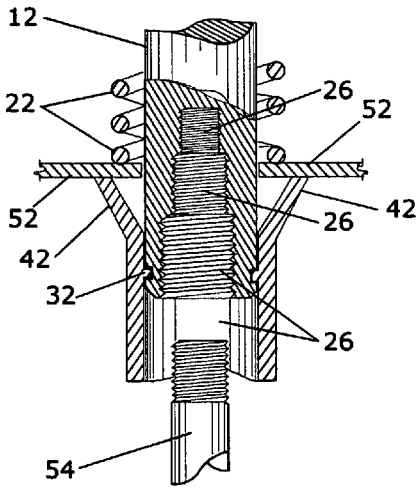
FIG. 8 illustrates a side elevation partial cut away view of the concrete insert according to an embodiment of the invention.
Figure 7:
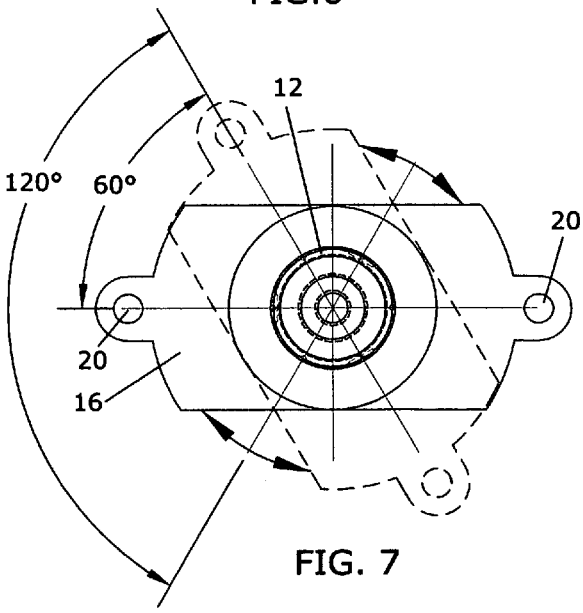
FIG. 7 illustrates a rotational movement of the plate about the shaft according to an embodiment of the invention.
Figure 9:
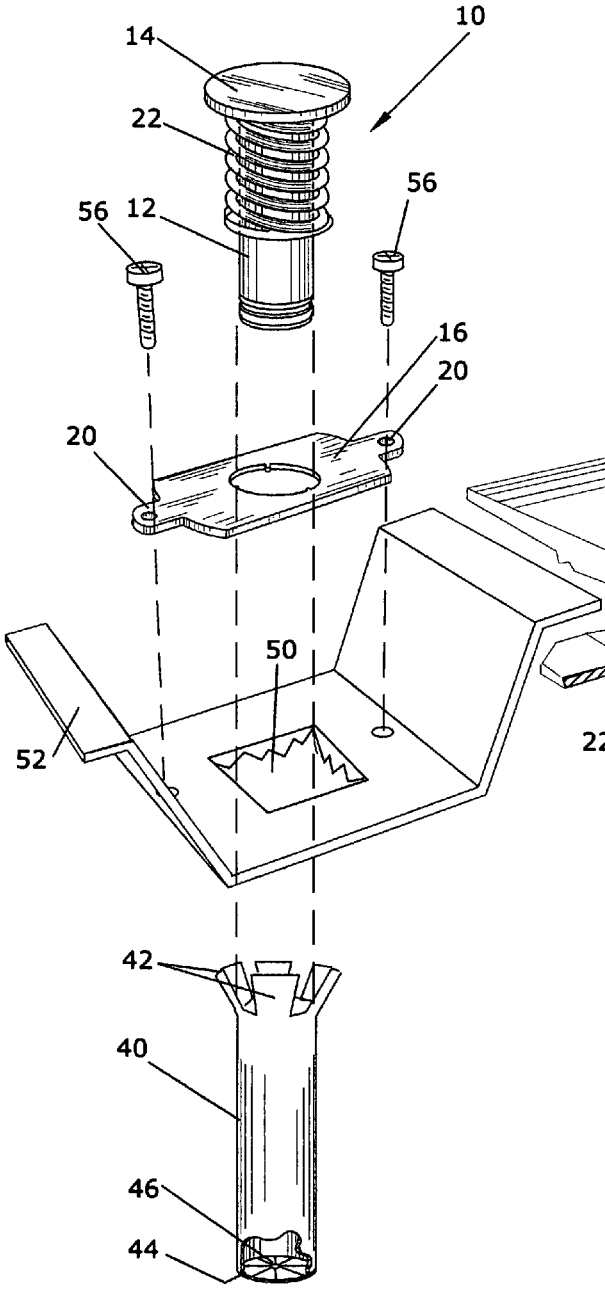
FIG. 9 illustrates a perspective exploded view of the concrete insert according to an embodiment of the invention.
Figure 10:
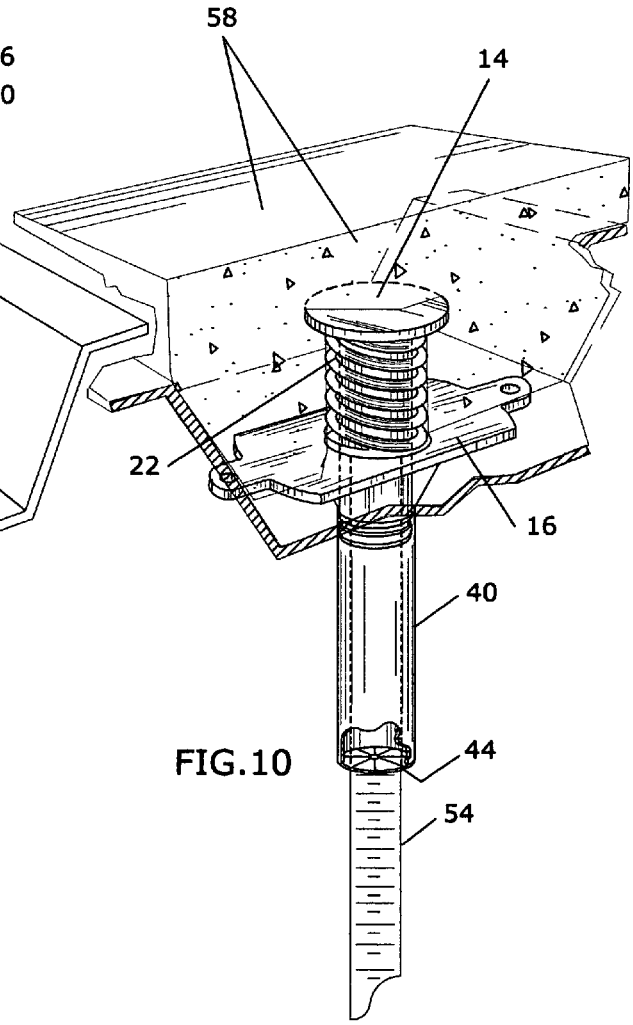
FIG. 10 illustrates a perspective view of a concrete insert positioned in a metal deck according to an embodiment of the invention.

Referring to FIGS. 8 through 10, the concrete insert 10 when assembled, shown disassembled in FIG. 9, may be positioned in an access hole 50 in a metal deck 52 or other concrete form structure. The access hole 50 may be formed by using a punch or a drill. The sleeve 40 may then be inserted in the access hole 50 to rest on the fingers 42. A hammer or similar device may be used to strike the head 14 to force the sleeve 40 through the access hole 50. Screws 56, rivets or the like may be inserted through the mounting holes 20 to attach the plate 16 to the metal deck 52. Concrete 58 may then be poured on the metal deck 52 that may enclose the upper portion of the concrete insert 10. A support rod 54 may be pushed through cover 46 to be threadably engaged with one of the hole 26 threaded walls.

While the invention has been particularly shown and described with respect to the illustrated embodiments thereof, it will be understood by those skilled in the art that the foregoing and other changes in form and details may be made therein without departing from the spirit and scope of the invention.

We claim:

1. A device for disposing in concrete structures for attachment of support fasteners comprising:

a shaft having a head at a first end and a hole therein at a second end, a plurality of slots disposed in an external surface oriented parallel to said shaft longitudinal axis and extending to said second end, a plurality of retaining recesses disposed in said external surface intermediate said slots and approximately parallel to said slots wherein said retaining flats do not extend to said second end, and a plate groove circumferentially formed in said external surface intermediate said first end and said second end wherein said plate groove intersects said slots and said retaining recesses;

a plate having an aperture that is the approximate form of a lateral cross section of said shaft wherein said aperture at an edge having a plurality of projections extending radially inward disposed to engage said slots when said shaft is slidably inserted in said aperture;

a spring disposed on said shaft retained between said head and said plate slidably disposed on said shaft; and said plate retained on said shaft against said spring force by rotating said plate in said plate groove from said slots to position said projections in said retaining recesses.

2. The device as in claim 1 wherein said plate having a mounting hole disposed for insertion of a fastener for fastening to a concrete pour form.

3. The device as in claim 1 wherein said shaft is of cylindrical form.

4. The device as in claim 1 wherein said plurality of retaining recesses are a plurality of retaining flats.

5. The device as in claim 1 wherein said shaft, said head, said plate and said spring are formed of metal.

6. The device as in claim 1 wherein a sleeve having an open first end with a plurality of outwardly inclined fingers is press fit at said open first end onto said second end of said shaft having a sleeve groove disposed in said external surface adjacent said second end.

7. The device as in claim 6 wherein said sleeve having an open second end having a cover that is formed for insertion of a support rod.

8. The device as in claim 7 wherein said cover is serrated.

9. The device as in claim 6 wherein said sleeve is constructed of plastic.

10. The device as in claim 1 wherein said hole having a plurality of inside diameter portions.

11. The device as in claim 10 wherein said hole is circular in form and said inside diameter portions are circular bores of different diameters with threaded walls.

* * * * *